US005534901A

United States Patent [19]

Drake

[11] Patent Number: 5,534,901

[45] Date of Patent: Jul. 9, 1996

[54] INK JET PRINTHEAD HAVING A FLAT SURFACE HEATER PLATE

[75] Inventor: Donald J. Drake, Rochester, N.Y.

[73] Assignee: Xerox Corporation, Stamford, Conn.

[21] Appl. No.: 254,793

[22] Filed: Jun. 6, 1994

[51] Int. Cl.[6] ..... B41J 2/335

[52] U.S. Cl. ..... 347/63; 347/64

[58] Field of Search ..... 347/63, 64, 65

[56] References Cited

U.S. PATENT DOCUMENTS

| | | | |
|---|---|---|---|
| Re. 32,572 | 1/1988 | Hawkins et al. | 156/626 |
| 4,638,337 | 1/1987 | Torpey et al. | 346/140 |
| 4,847,630 | 7/1989 | Bhaskar et al. | 347/63 |
| 5,010,355 | 4/1991 | Hawkins et al. | 347/63 |
| 5,229,785 | 7/1993 | Leban | 347/63 |
| 5,412,412 | 5/1995 | Drake et al. | 347/43 |
| 5,450,108 | 9/1995 | Drake et al. | 347/65 |

*Primary Examiner*—Valerie A. Lund
*Attorney, Agent, or Firm*—Tallam I. Nguti

[57] ABSTRACT

An improved ink jet printhead including a channel plate and a heater plate having an improved flatness top bonding surface. The heater plate includes a silicon wafer base, a first insulating layer formed on the wafer base, and at least an intermediate component sublayer formed over the first insulating layer. The heater plate also includes a second insulating layer formed over the at least intermediate component sublayer, and having a top bonding surface for bonding the: heater plate to the channel plate. To substantially improve flatness of the top bonding surface of the second insulating layer, the component sublayer includes active thin film layer patterns in circuit areas of the thin sublayer, and non-active relief compensating patterns in non-circuit areas thereof. The non-active relief-compensating patterns each have a thickness substantially equal to the thickness of the active thin film patterns in the circuit areas of the sublayer.

17 Claims, 8 Drawing Sheets

INK JET PRINTHEAD HAVING A FLAT SURFACE HEATER PLATE

BACKGROUND OF THE INVENTION

The present invention relates to a thermal ink jet printhead and method of manufacture thereof, and more particularly to a thermal ink jet printhead having an improved flat, top surface heater plate that is bonded to a channel plate during fabrication.

Typically, thermal ink jet printing systems each include an ink jet printhead for ejecting ink droplets on demand by the selective application of current pulses to an array of thermal energy generators. The thermal energy generators are located individually in parallel, capillary-filled ink channels in the printhead. Each thermal energy generator, usually a resistor, is located as such at a predetermined distance upstream of the droplet ejecting nozzle or orifice of the channel. U.S. Re. 32,572 to Hawkins et al exemplifies such a thermal ink jet printhead and several fabricating processes therefor.

Conventionally, each such printhead is composed of two separately fabricated parts that are aligned and bonded together. One such part is a substantially flat substrate or plate (the heater plate) which contains a linear array of heating elements and related addressing elements. The other part is also a substrate or plate (the channel plate) having at least one recess anisotropically etched therein to serve as an ink supply manifold when the two parts are bonded together. Additionally, other recesses or grooves forming a parallel array are also etched in the channel plate and form ink channels upon the bonding of the plates. The grooves are each formed such that one end thereof communicates with the ink supply manifold, and the other end is open so as to function as an ink droplet ejecting nozzle of the resulting channel.

As described for example in the Hawkins et al patent, many printheads of this type can be manufactured simultaneously. To do so, a plurality of sets of heating element arrays with their addressing elements are fabricated on a first silicon wafer to form the heater plate, and alignment marks are placed thereon at predetermined locations. A corresponding plurality of sets of channel grooves and associated manifolds are then formed in a second silicon wafer to constitute the channel plate, and alignment openings are etched in the channel plate at predetermined locations. The heater and channel plates are then aligned via the alignment openings and alignment marks, bonded together, and diced into many separate individual printheads.

Improvements to such two part thermal ink jet printheads are described for example in U.S. Pat. No. 4,638,337 to Torpey et al which discloses a printhead similar to that of Hawkins et al, but has each of its heating elements located in a recess or heater pit. The walls of the recess or heater pit function to prevent lateral movement of heated ink moving over the heater element towards the nozzle. As such, the recess or heater pit acts to prevent the sudden release of vaporized ink to the atmosphere, an occurrence known as "blow-out". "Blow-outs" as such are undesirable because they can cause ingestion of air into the printhead and hence interruption of the printhead operation. In the Torpey et al patent, a thick film insulating layer of an organic structure, such as polyimide, Riston® or Vacrel®, is formed on top of the heater plate prior to bonding. The recesses or heater pits are formed in this thick film layer. As a result of this improvement, the top surface of the heater plate for bonding to the channel plate is therefore that of a thick film insulating layer. The thick film insulating layer as such serves as an ink insulation, and as a protection layer for the heating and circuit elements of the heater plate. As such, the thick film layer is preferably made of polyimide because polyimide is impervious to water—a major common component of inks used in ink jet printheads.

In the manufacture of the two plate-printhead as above, the top surface of the heater plate as such must be precisely and thoroughly bonded to the channel plate in order to effectively isolate ink within the channels. Typically, a thin uniform layer of adhesive material is used for such bonding. The flatness of the bonding surfaces of the plates, and the thickness of the adhesive layer are critical to the effectiveness of such bonding. The thickness of the adhesive layer, for example, should not be insufficient, nor should it be too much. Too much or too thick an adhesive layer tends to cause the adhesive to spread or wick from the coated surface into adjacent channels, thereby interfering with consistent printhead firing characteristics. On the other hand, insufficient adhesive layer thickness, for example, leads to poor adhesion or poor bonding between the heater and channel plates, and hence to a host of problems including, cross-talk, poor channel firing consistency, and ink droplet size variations.

Such poor adhesion with its attendant problems can also result when the bonding surfaces of the plates are not sufficiently flat. The degree of flatness or non-flatness of the bonding surfaces of these plates, particularly that of the heater plate, is significantly determined in part by the materials forming the plate, and by its process of fabrication.

Conventionally, the channel and heater plates are each fabricated from a silicon wafer. In the case of the channel plate, the recesses or grooves therein are formed in the wafer, for example, by an anisotropic etching process. In the case of the heater plate, patterned layers of heating elements and their related addressing circuit elements are fabricated on the silicon layer along with protective and insulative layers including the top, thick polyimide insulation layer.

Unfortunately, however, the polyimide material which form the top bonding surface has a tendency to produce unwanted surface topographical variations. Such unwanted surface variations are caused by formations such as raised edges or "lips" (1–3 microns high) which occur around any photoimaged edge. For example, such formations occur around the edges of the heater and bypass, pits. Such raised edges and "lips" formations ordinarily affect the flatness of the top bonding surface of the heater plate, and thus tend to result in undesirably poor adhesion or poor bonding between heater and channel plates of printheads. Another undesirable type of polyimide top surface topographic formation occurs as "edge beads" or raised areas at the edges of the heater plate. The edge bead on a 4 inch diameter heater plate, for example, can be on the order of 0.5 inch wide extending radially from the outer edge thereof, and can have a thickness several micrometers higher than the rest of the polyimide layer.

In addition to the above mentioned and unwanted polyimide top surface formations, it has also been found that poor adhesion and poor bonding can result between the heater and channel plates as a result of area to area variations in the overall thickness of a completely fabricated heater plate. Such area to area variations which manifest themselves as high and low areas in the top surface of the top polyimide layer are caused, for example, by the existence of nonuniform, thin film sublayer patterns in the heater plate.

Examples of such non-uniform sublayer patterns are thin film active layers of heating elements and integrated circuit elements. Such active layer elements are formed, for example, by photopatterning a uniform layer of active thin film material and then etching off active thin film material from the non-circuit areas of the sublayer. The remaining sublayer patterns are believed to cause corresponding patterns of high areas on the top (polyimide) surface of the heater plate.

SUMMARY OF THE INVENTION

The present invention provides a thermal ink jet printhead that has an improved flat top surface heater plate which is bonded to a channel plate. According to one embodiment of the present invention, the method of fabricating the heater plate of the present invention includes making the thickness of each active component sublayer thereof substantially uniform by forming nonactive patterns in etched off non-circuit areas of the sublayer. According to a second embodiment, the method of fabricating the heater plate of the present invention includes isolating and retaining unetched thin film layer segments in the non-circuit areas of the sublayer by etching isolation gaps separating such layer segments from the active circuit patterns of the sublayer.

Accordingly, the heater plate of the present invention having the improved flat top bonding surface includes a wafer base having a substantially flat wafer surface. It also includes portions of a first insulating layer formed over the substantially flat wafer surface, and a second insulating layer that is spaced from the first insulating layer. The second insulating layer has a top surface for bonding the heater plate to a channel plate. The heater plate further includes at least a component sublayer of active patterns consisting of heater elements and circuit elements. The component sublayer is formed below the second insulating layer and through portions of the first insulating layer such that the active patterns thereof define non-circuit areas within the component sublayer. The heater plate then includes non-active relief compensating patterns formed within the defined non-circuit areas of the subcomponent layer for improving the flatness of the top surface of the second insulating layer of the heater plate by preventing the second insulating top layer from sagging in areas located over such non-circuit areas of the component sublayer.

In a first embodiment of the heater plate of the present invention, the non-active relief compensating patterns consist of non-active "dummy" patterns of a non-active material that are formed within the non-circuit areas of the component sublayer. In a second embodiment of the heater plate of the present invention, the non-active relief compensating patterns consist of unetched and retained thin film layer segments that are isolated within non-circuit areas from circuit areas by fully etched isolation gaps.

A more complete understanding of the present invention can be obtained by considering the following detailed description in conjunction with the accompanying drawings, wherein like index numerals indicate like parts.

BRIEF DESCRIPTION OF THEE DRAWINGS

Figure 5A:
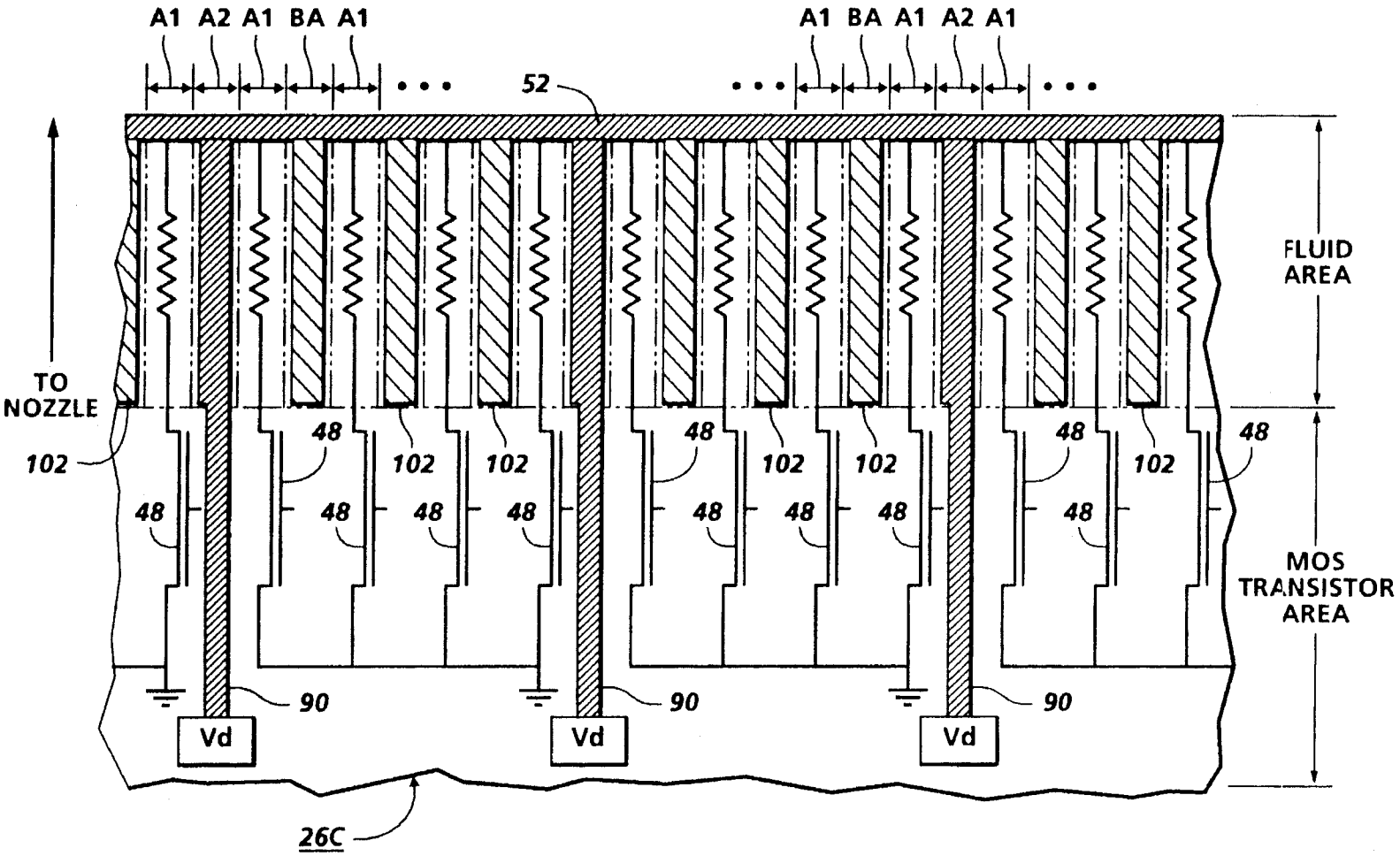
FIG. 5A is a schematic top plan view of the thin film metallization sublayer of a section of the heater plate of the present invention showing active patterns in circuit areas, and "dummy" patterns in non-circuit areas of the sublayer.
Figure 5B:
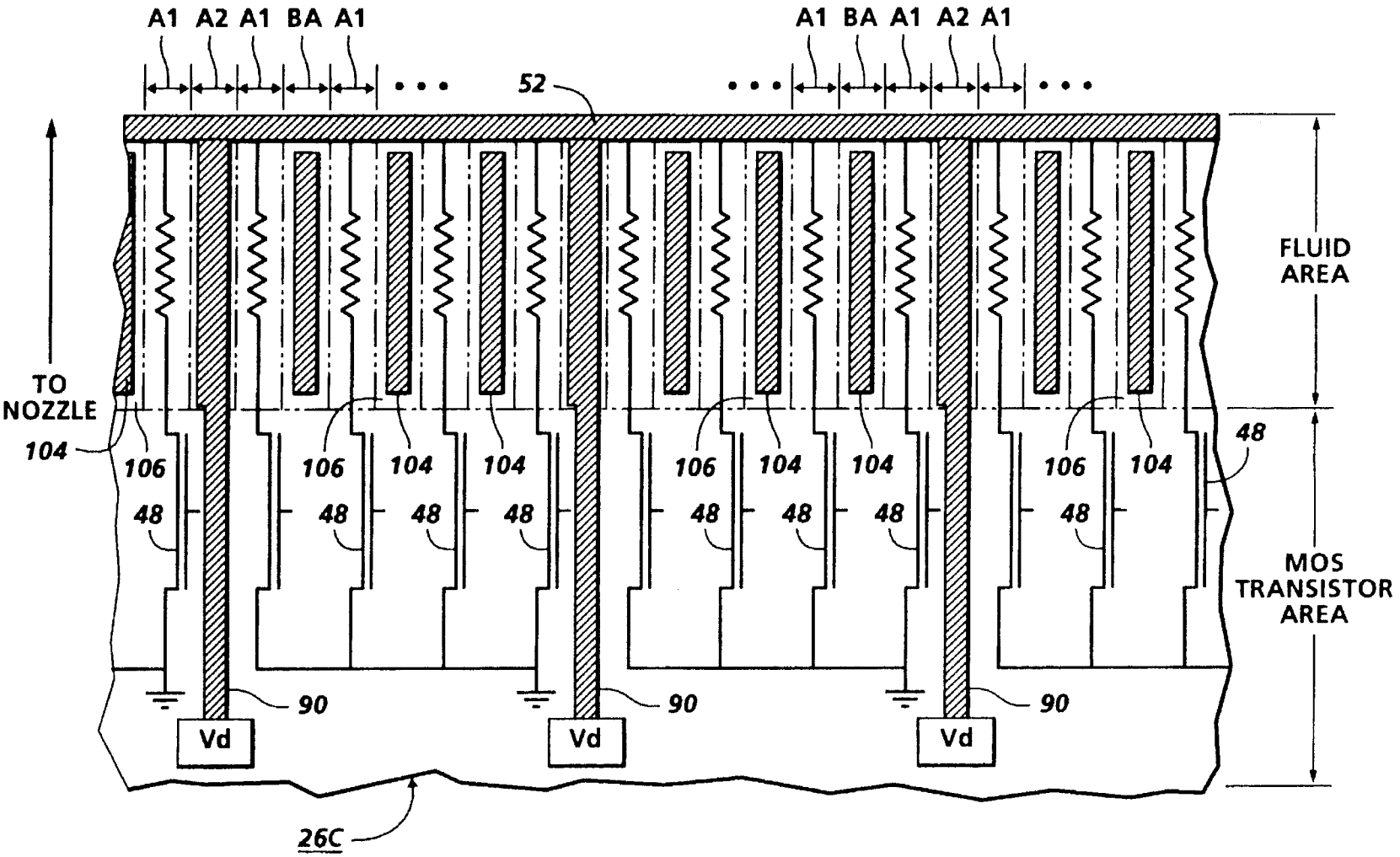
Figure 5C:
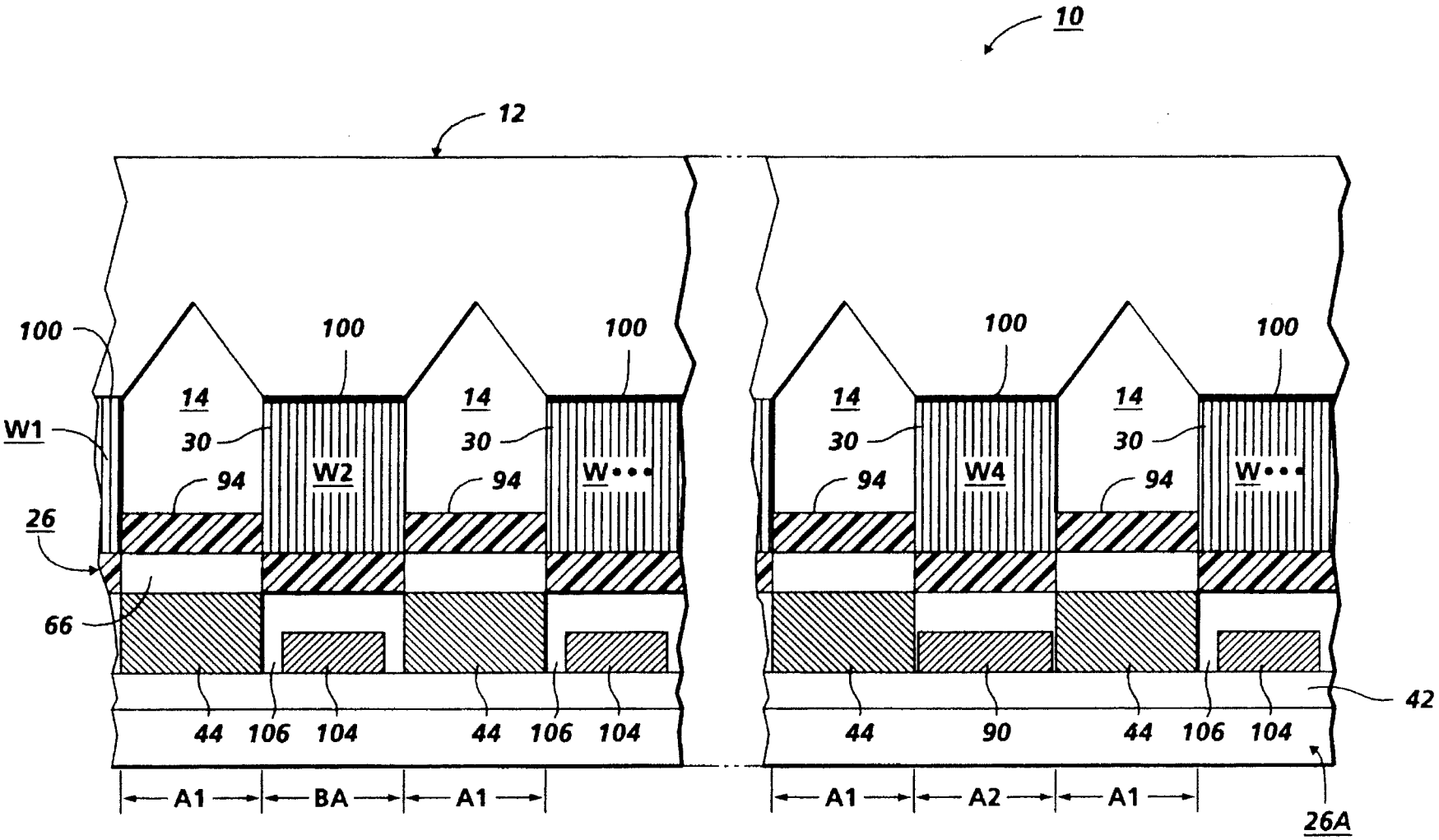

FIG. 5B is a schematic top plan view of the metallization sublayer of a section of the heater plate of the present invention showing active patterns in circuit areas, and isolated unetched and retained thin film layer segments in non-circuit areas of the sublayer; and FIG. 5C is a cross-sectional view of the printhead of the present invention seen along view line 3—3 (FIG. 2), using the heater plate of FIG. 5A or 5B and showing good bonding over circuit and non-circuit areas of the component sublayer of the heater plate.

DESCRIPTION OF THE PREFERRED EMBODIMENT

Figure 1:
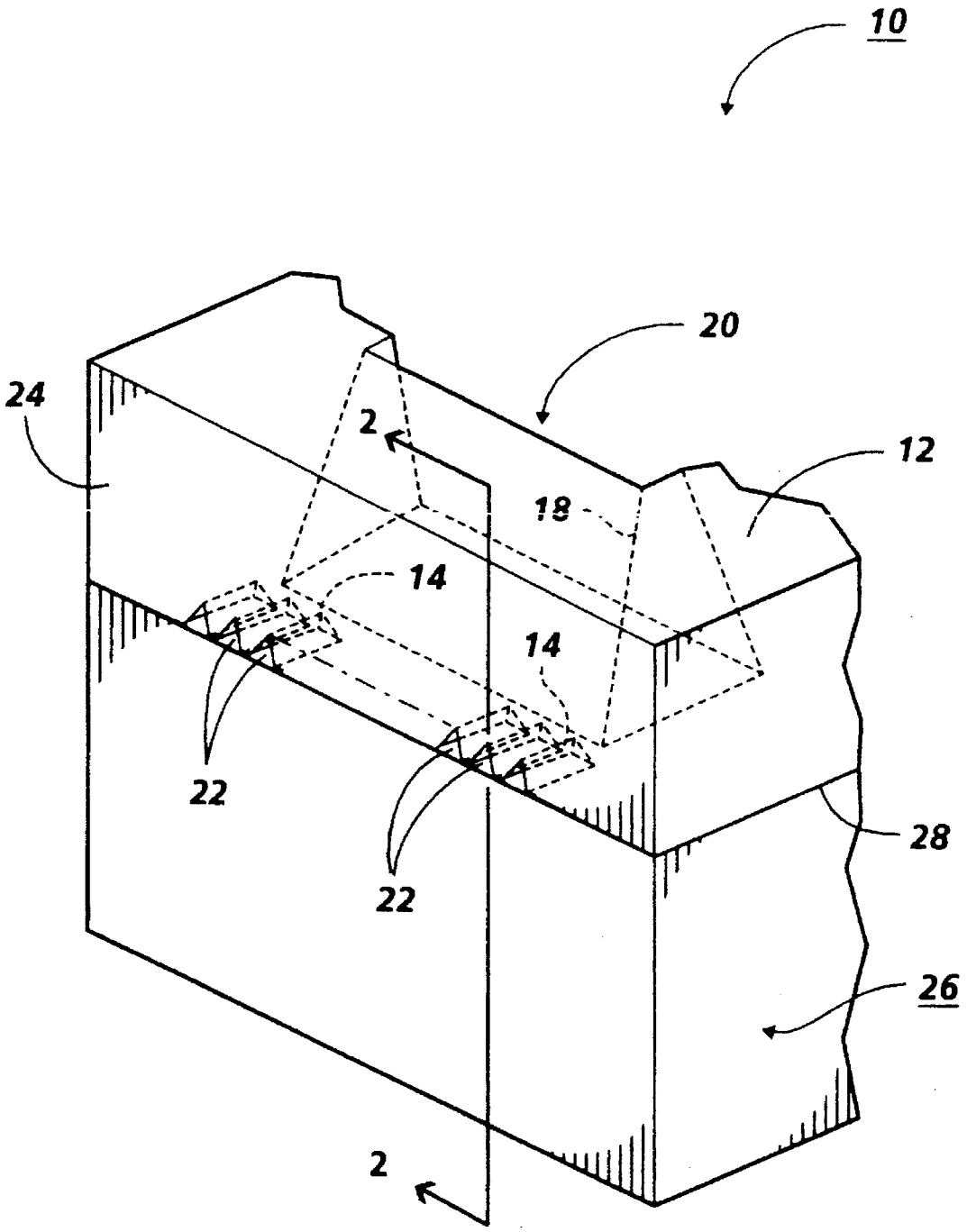
FIG. 1 is an enlarged isometric view of a printhead incorporating the present invention.
Figure 2:
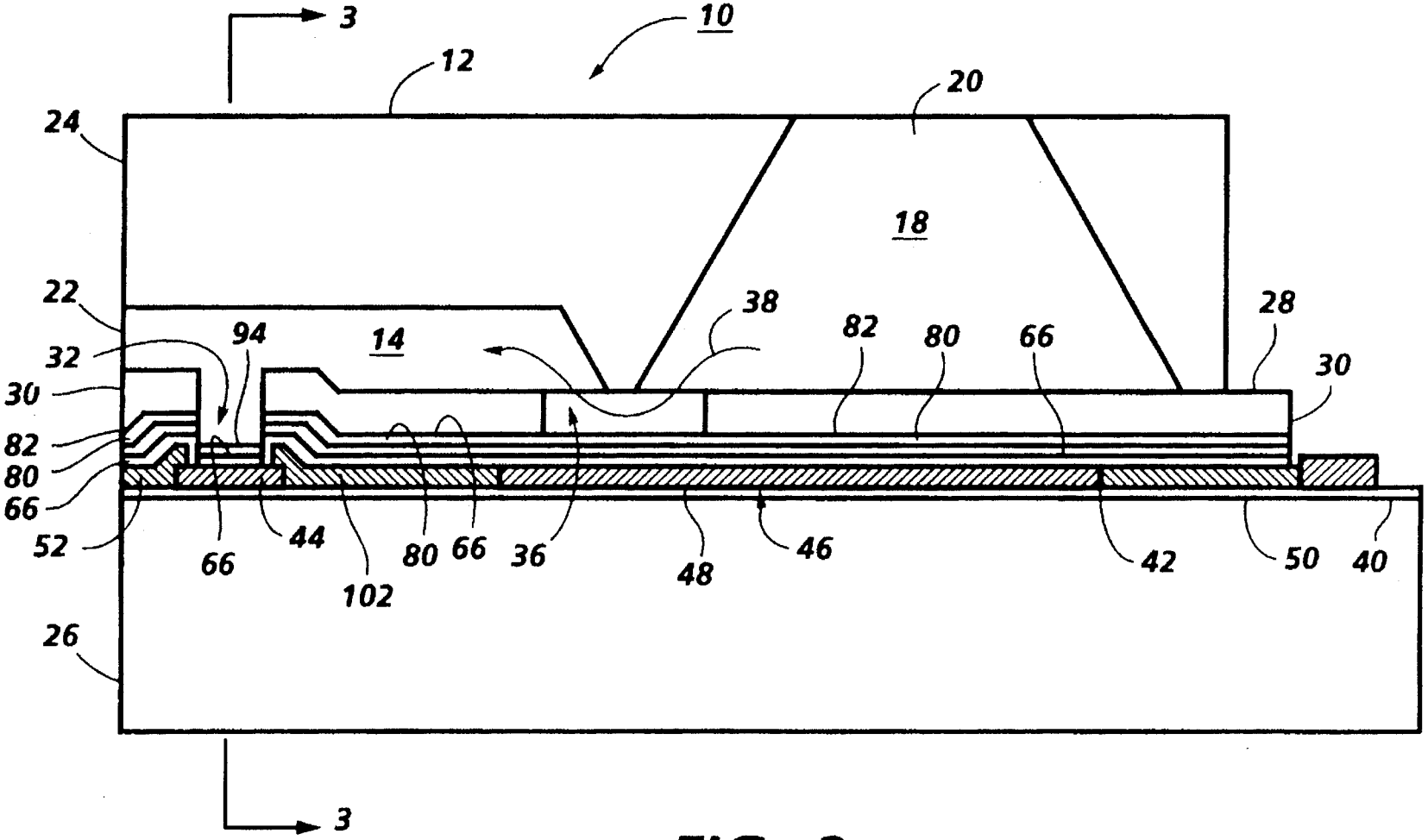
FIG. 2 is an enlarged cross-sectional view of FIG. 1 as viewed along viewline 2—2 thereof.

Referring now to FIGS. 1 and 2, a thermal ink jet printhead 10 incorporating the present invention is depicted. As shown, the printhead 10 includes a first substrate or channel plate 12 that has an array of grooves for forming ink carrying channels 14, anisotropically etched into a bonding first surface thereof. The channel plate 12 also has formed therein a recess 18 that ends in an open hole 20 through a second surface opposite the bonding first surface. As further shown, each groove for forming an ink carrying channel 14 extends from a point proximate the recess 18 to an open nozzle 22 in a front surface 24 of the channel plate 12.

The printhead 10 also includes a second substrate or heater plate 26 that contains protected and insulated heating elements and integrated circuit elements of the printhead (to be described below), and that has a top bonding surface 28. The top bonding surface 28 is also the top surface of a photopatterned polyimide insulation layer 30 (FIG. 2) of the heater plate 26 in which heater pits 32 and ink bypass pits 38 are formed. Heater plate 26 as such is aligned with, and bonded to, the channel plate 12 as shown, such that the recess 18 forms an ink manifold for the ink carrying channels 14, and such that the open hole 20 serves as an ink fill hole for the ink manifold.

The bonding of the channel plate: 12 to the heater plate 26 is ordinarily an integral step in the process of manufacturing thermal ink jet printheads. Poor bonding, for any of a variety of reasons including the presence of significantly high and low areas on the top bonding surface 28 of the heater plate, can result in poor ink isolation between adjacent channels. Such high and low areas on the top bonding surface 28 of the heater plate have been found for example to stem from a number of sources. One such source is attributable to curing phenomena such as "raised lips" and raised "edge beads" peculiar to polyimide material which as discussed above is conventionally used as the top insulation layer 30 in heater plate fabrication.

Details and proposed solutions to such high and low areas resulting from polyimide curing phenomena are disclosed in commonly assigned U.S. patent applications Ser. No. 07/126,962 entitled "Ink Jet Printhead Which Avoids Effects Of Unwanted Formations Developed During Fabrication", and Ser. No. 07/997,473, entitled "Ink Jet Printhead Having Compensation For Topographical Formations Developed During Fabrication". Both applications were filed on December 28, and are being incorporated herein by reference.

As also mentioned above, another source of undesirable high and low areas on the top bonding surface 28 of the heater plate has been found to be uncompensated-for topographical variations created in a sublayer of the heater plate during heater plate fabrication. For example, such topographical variations have been found to be caused by non-uniformity in thickness of etched off patterns and active patterns of circuit elements, of a component sublayer formed underneath the top polyimide insulation layer 30 during fabrication of the heater plate.

Figure 3:
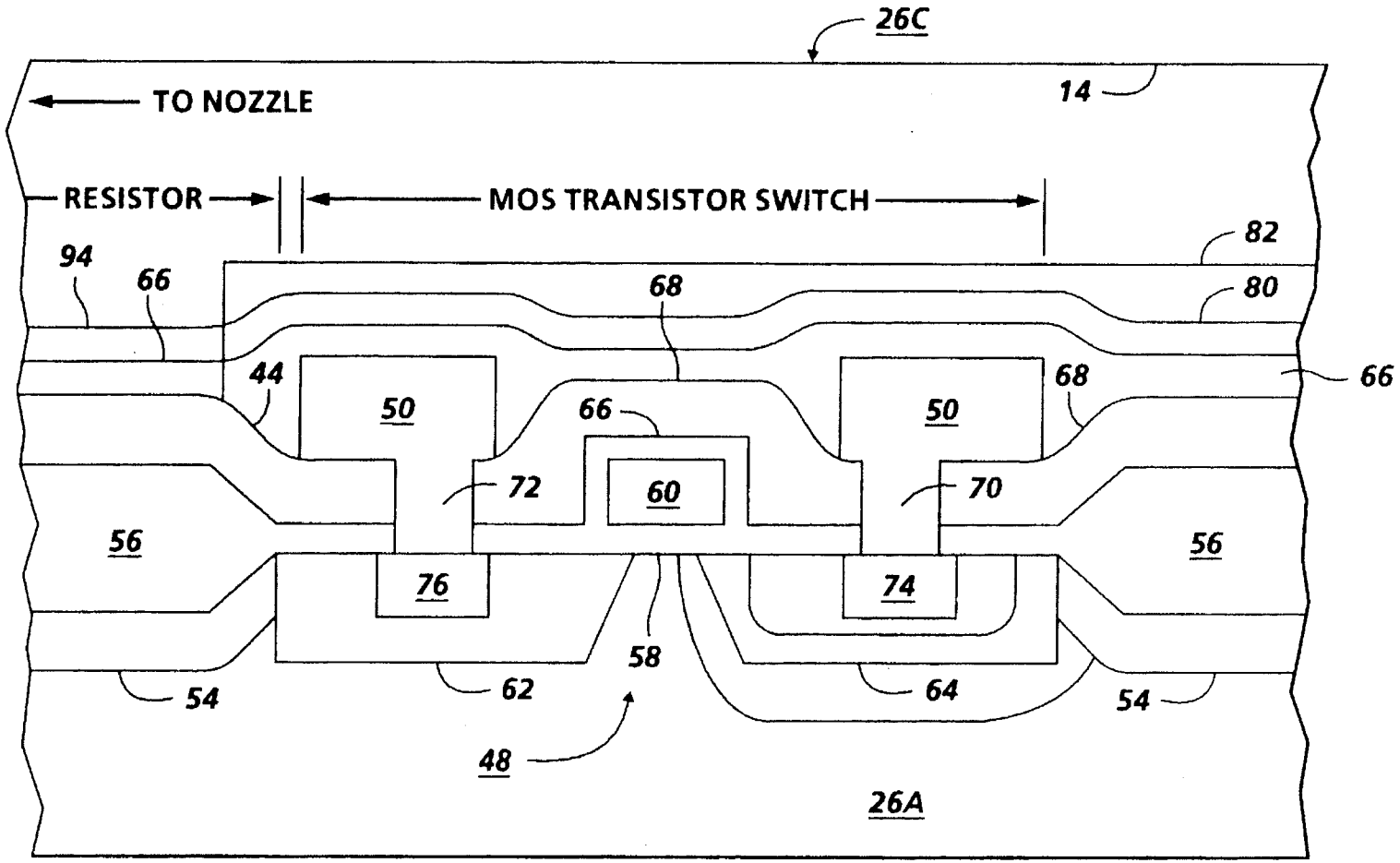
FIG. 3 is an enlarged longitudinal-section view of a typical MOS transistor switch (driver) monolithically integrated with a heater element in the heater plate of the present invention.
Figure 4A:
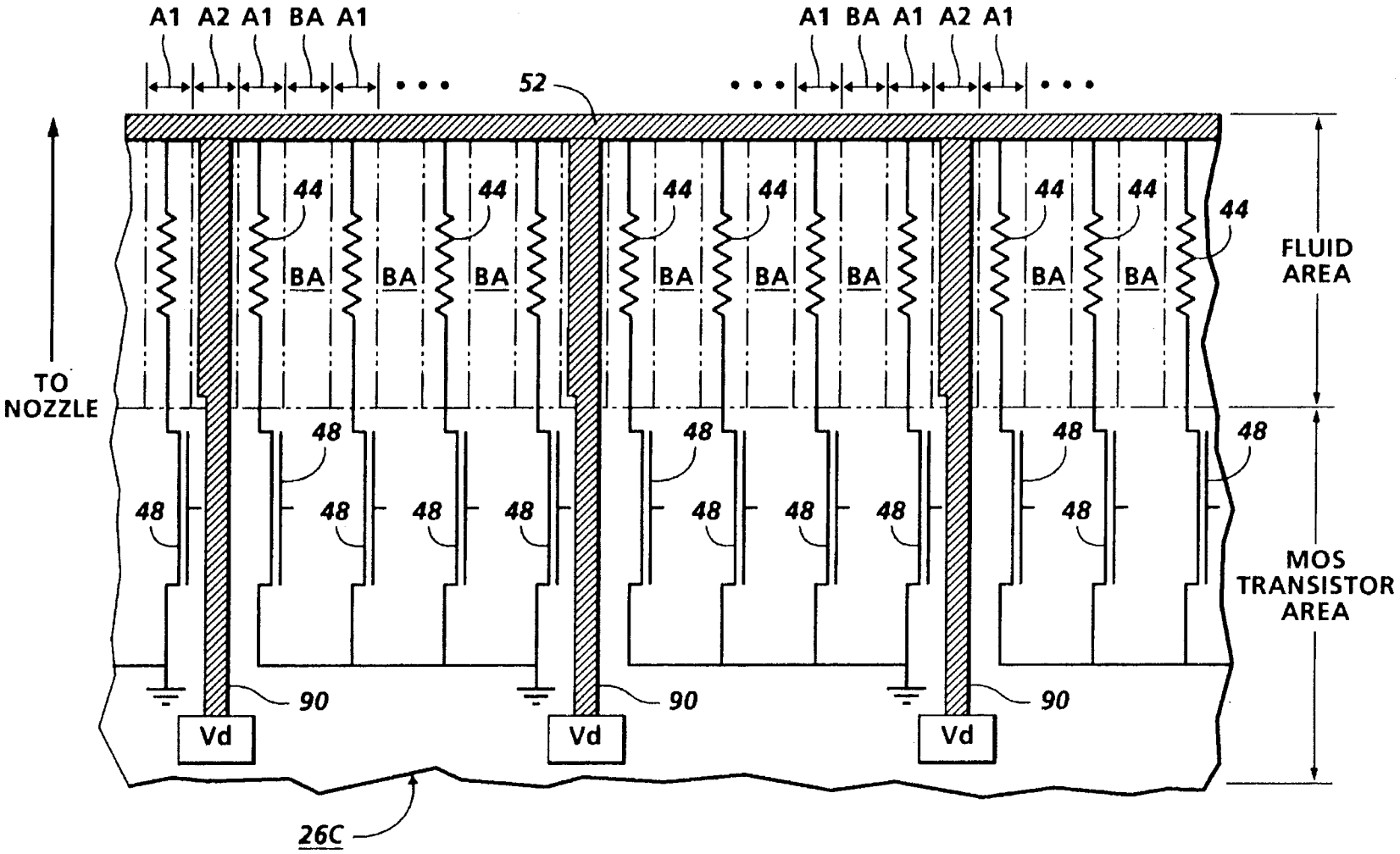
FIG. 4A PRIOR ART
FIG. 4A is a schematic top plan view of the metallization component sublayer of a section of a conventional heater plate showing circuit and non-circuit areas of the metallization sublayer.
Figure 4B:
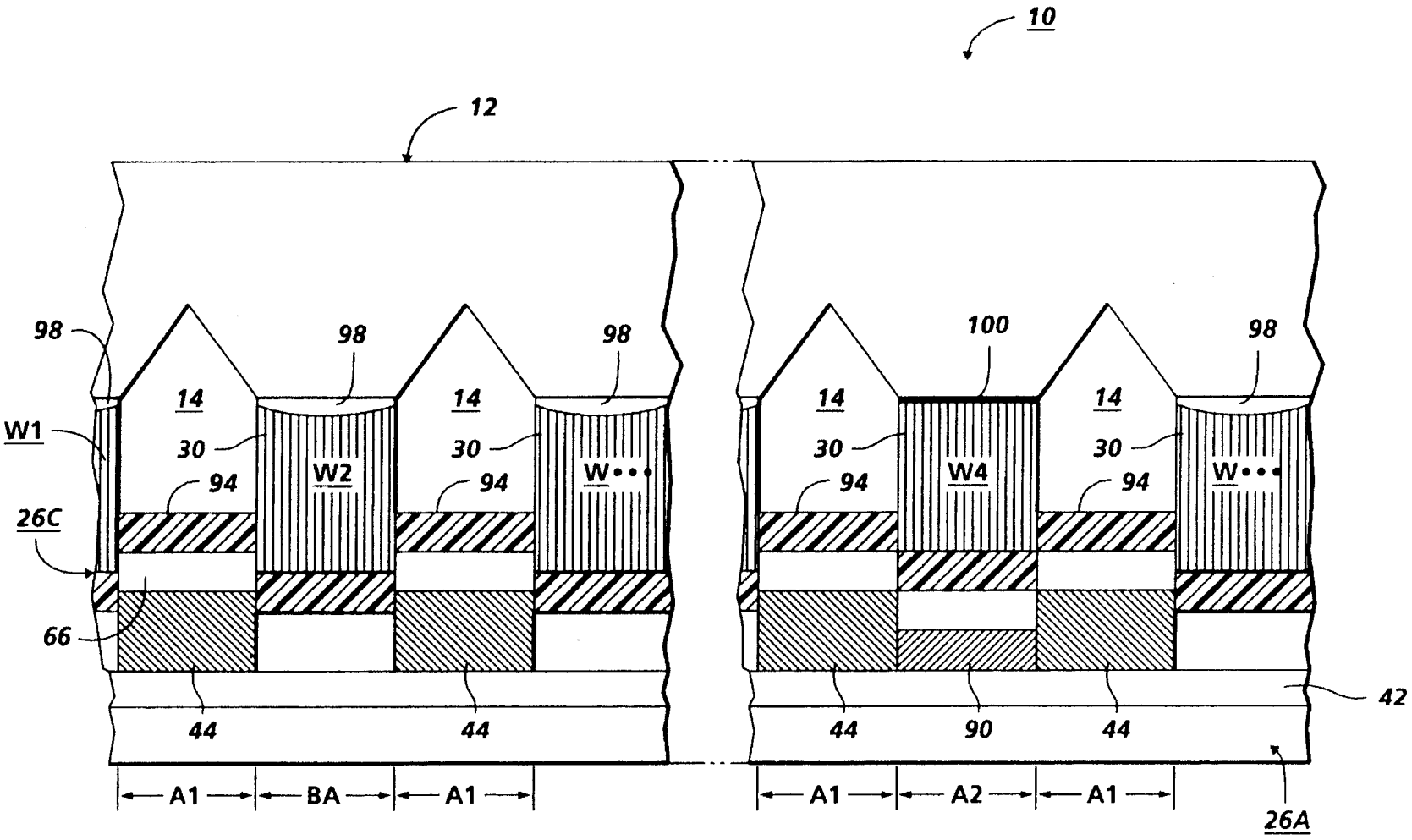
FIG. 4B PRIOR ART
FIG. 4B is a cross-sectional view of a printhead seen along view line 3—3 (FIG. 2), using the conventional heater plate of FIG. 4A and showing poor bonding over non-circuit areas of the metallization sublayer.

The formation of such non-uniform thickness patterns can be appreciated more by referring now to FIGS. 3–4B. FIG. 3 illustrates a heater plate 26C fabricated, for example, according to a conventional method. According to the conventional method, a single side polished (100) p type silicon wafer base 26A has its polished top surface 40 coated with an underglaze layer 42 of silicon dioxide. Polysilicon heating elements 44, and related monolithic electronic circuit elements 46 are next formed over the underglaze layer 42. The circuit elements 46 for example include a transistor switch 48, matrix electrodes 50 and a common return 52. The circuit elements 46 and the heating elements 44 are formed for example, by processing the silicon wafer 26A by the LOCOS (local oxidation of silicon) process to form a thin $SiO_2$ layer (which is subsequently etched off selectively, and thus not shown in this section), followed by deposition of a uniform layer of silicon nitride ($Si_3N_4$). The silicon nitride layer is also subsequently etched off the transistor areas (and thus not shown). A photoresist layer ( which as is well known is later removed and hence not shown) is applied and photopatterned, using a mask, over the areas of the $Si_3N_4$ layer which will form active patterns. Photoresist is also used to block a channel stop boron implant 54 from the active transistor areas. The channel stop boron implant 54 is aligned to field oxide areas 56. The photoresist is then removed and the partially fabricated wafer 26A is cleaned in a series of chemical solutions, and heated to a temperature of about 1000° C.

Steam is flowed past the wafer 26A to oxidize the surface thereof for several hours and to therefore grow field oxide layer 56 to a thickness of at least 1 μm. $Si_3N_4$ and thin $SlO_2$ layers are then removed in order to leave bare silicon patterns in active areas identified in FIG. 3 as "MOS Transistor Switch". Gate oxide layer 58 is then grown in the bare silicon pattern areas, and a single uniform thin film layer of polysilicon having a desired thickness is deposited and photopatterned using photoresist, a mask, UV light, developer, and etching solution, in order to form transistor gates 60 and the heating element resistors 44. In addition to the polysilicon gates 60 which are used to mask ion implantation from the active transistor device channel area, a lightly doped source 62 and drain 64 are also formed.

The partially fabricated heater plate 26A at this point is cleaned and re-oxidized to form a silicon dioxide layer 66 over gate 60 and over heating elements 44. A phosphorus doped glass layer 68 is deposited on the thermal oxide layers 66 and 56, and is flowed at high temperatures in order to planarize the surface. Photoresist is again applied and photopatterned to form vias 70 and 72 to drain 64 and source 62, respectively, and to clear the glass from the silicon dioxide layer 66 over the heating element 44. Preferably, contact areas for the heating and circuit elements are then heavily doped by n+ion implants 74, 76 in order to allow ohmic contact of the lightly doped drain and source layers 64, 62 with aluminum metallization interconnections to be deposited later.

Following the thermal cycle necessary to activate the heavily doped regions 74, 76 the substantially fabricated wafer 26A is cleaned, and a uniform, thin film aluminum metallization layer is deposited and patterned to form active interconnecting patterns 90 (FIGS. 4A, 5A, and 5B) with the common return 52 and hence with the matrix addressing electrodes 50. The active patterns thus provide interconnections to the source, drain and heating elements. The oxide layer 66 typically has a thickness of 0.5 to 1 μm in order to effectively protect and insulate the heating elements 44 from conductive ink used in such printheads. The oxide, however, is removed from the central portion of the heating elements 44, and a composite passivation layer 92 of silicon nitride, followed by a second passivation layer 94 of sputtered tantalum (Ta) are deposited and patterned over the central region of the heating elements 44. The tantalum layer 94 is then etched off all but the protective layer 66 directly over the heating elements 44 using, for example, a $CF_4/O_2$ plasma etching technique. Next, a plasma (silicon) nitride layer (not shown) having a thickness range of 2500 A to 2 μm, with a preferred thickness of μm is deposited over the Ta layer 94. The heating elements 44, and electrode terminals therefor are then cleared of both oxide and nitride layers. The plasma nitride layer (not shown) is dry-etched to remove it from the Ta layer 94 and from the electrode terminals. A thick film, photopatternable insulative layer 30, for example, a polyimide layer, is then formed over the two passivation layers 92, 94 in order to provide additional passivation. The polyimide layer 30 as such also provides the medium in which the heater pits 32 and the ink flow bypass pits 36 are formed. More importantly, the polyimide layer 30 forms the top surface 28 of the heater plate which is associated with the problem of high and low areas being addressed by the present invention.

Referring now to FIG. 4A, a top plan view of the metallization layer of a conventional heater plate made as above, is shown. Viewed from left to right, for example, the metallization layer includes circuit areas shown as A1 and A2, as well as non-circuit areas BA. As illustrated, active patterns of heating elements 44 each with a dedicated transistor switch pattern 48 are formed within the circuit areas A1, and are each located directly back of a nozzle area. The heating elements are formed as such so that they lie within the fluid region of the heater plate 26C. The fluid region as shown is located towards the nozzle side of the printhead.

As further illustrated, active thin film metallization patterns 90 are formed within the circuit areas A2, and serve to interconnect the heating elements 44 and their respective transistor switches 48 through a common return 52 to a power supply source Vd. In this particular heater plate circuit design, the power source Vd is repeated in order to avoid unacceptable voltage drops from one side to the other of the heater plate. Conventionally, the non-circuit areas BA as illustrated in the metallization layer, are areas from which segments of the thin film metallization layer have been etched off or removed as described above. As a result such non-circuit areas BA become low areas relative to at least the thin film metallization pattern 90 in the circuit areas A2.

As illustrated in FIG. 4B, when a conventional heater plate with such high and low areas is used to form a printhead, poor adhesion or poor bonding shown as gaps 98 is likely to result over low areas BA. As shown, the low areas BA of the metallization layer of the heater plate 26C can exist within walls W1, W2 . . . Wn located between ink channels 14 in the fluid region of the printhead. The poor adhesion gaps 98 occur above these walls, it is believed, because the polyimide layer 30 upon curing tends to sag in locations over the low areas BA. Note, however, that a similar between-channel wall shown as "W4" and formed over a high area A2, that is a circuit area within which a metallization pattern 90 is located, exhibits a good bond 100 with the channel plate.

Therefore, in accordance with the present invention, an improved heater plate 26 is provided in which good adhesion or good bonding is achieved over all the walls by substantially eliminating low and high area variations in the topography, for example, of the metallization sublayer. As described above, the fabrication of a heater plate typically involves the formation and photopatterning of active layers that include but are not limited to silicon dioxide layers, a polysilicon layer, a silicon nitride layer, and an aluminum metallization layer. These active layers are formed by various known methods, and in an appropriate sequence. Each layer is then photopatterned to conform to the active circuit patterns of a chip or component circuit in that sublayer.

The formation of each sublayer as such involves growing or depositing a uniform thin film layer of the material forming the layer. As formed, the uniform thin film layer initially covers both circuit and non-circuit areas within the particular sublayer. The photopatterning process then involves applying a layer of photoresist material over the entire thin film layer. The photoresist layer is partially cured, for example, by soft baking under a low temperature. A patterned mask is then positioned above the photoresist layer. The conventional patterned mask has open portions corresponding to the active patterns to be formed in the circuit areas of the layer, and solid opaque portions corresponding to non-circuit areas of the layer. Ultraviolet (UV) light is focused onto the photoresist layer through the patterned mask, thereby exposing, and polymerizing sections of the photoresist layer through the open portions.

Conventionally, the photoresist layer is then developed chemically to remove unpolymerized photoresist from the unexposed areas. The remaining photoresist patterns are then hard baked at a high temperature in order to increase their adherence to the thin film layer below. The exposed non-active segments of thin film that are now surrounded or defined by the hard-baked patterns of photoresist, are then chemically etched off or removed. Finally, the hard-baked patterns of photoresist are also removed leaving thereunder in the circuit areas only active patterns of the particular thin film material. As discussed above, the active patterns of the thin film layer which are retained in the circuit areas thus create significantly high areas relative to the etched off non-circuit areas of that layer.

Therefore, as shown for example in FIGS. 5A and 5B, the heater plate 26 of the present invention is fabricated such that it includes non-active relief-compensating patterns 102, 104 in the non-circuit areas of each thin film sublayer. The purpose of the non-active relief-compensation patterns 102, 104 is to improve the flatness of the top surface 28 of the polyimide insulation layer 30 of the heater plate, by preventing such layer 30 from sagging in areas thereof that are located above the non-circuit areas of each thin film sublayer. In FIGS. 5A and 5B, the thin film metallization layer is illustrated for example, but the same can be done for the other thin film layers, such as the silicon dioxide and the polysilicon layers.

Accordingly, in a first embodiment of the heater plate 26 of the present invention as illustrated in FIG. 5A, an active thin film sublayer having a predetermined thickness is formed and photopatterned conventionally as described above, and the non-circuit areas thereof are chemically etched off. A uniform "dummy" sublayer of an inactive material, such as phosphosilicate glass, is then formed to a thickness substantially equal to the predetermined thickness of the preceding layer of thin film material. The "dummy" sublayer is then photopatterned using a mask that is reversed relative to that used for the layer of thin film material. The reversed mask as such has open portions that correspond to non-circuit areas of the thin film material layer, and solid opaque portions that correspond to circuit areas thereof. Note that when the 'dummy' layer is being formed there are active patterns of the thin film material already formed in such circuit areas. When the non-active "dummy" sublayer is photopatterned as such using the reversed mask, the result is non-active "dummy" patterns 102 (FIG. 5A ) in the non-circuit areas of the thin film sublayer. As a result, the non-circuit areas BA instead of being low areas (as shown in FIG. 4A) now each have a "dummy" pattern 102 formed therein having substantially the same thickness as the active patterns 90 in the circuit areas of the sublayer. These "dummy" patterns 102 therefore function along with the active patterns 90 to create a substantially uniform thickness in both circuit and non-circuit areas of the sublayer.

In an alternative embodiment of the present invention as illustrated in FIG. 5B, a uniform thin film sublayer of an active material is initially formed over both circuit and non-circuit areas of the sublayer. The sublayer of thin film material is then advantageously photopatterned using "a non-active area isolation mask" instead of a conventional patterned mask. A "non-active area isolation mask" in this case has conventional open portions corresponding to the circuit areas of the sublayer, e.g A2 areas. More importantly however, the isolation mask also has open portions corresponding substantially to all of the area of each non-circuit area BA of the sublayer, and solid opaque portions corresponding only to "etchable isolation gaps" 106. The "isolation gaps" 106 are designed and formed to surround the non-circuit areas BA, and when fully etched off, will function to isolate thin film layer segments 104 FIG. 5B, that are retained within the non-circuit areas BA of the sublayer instead of being etched off or removed as is conventional. As such, these thin film layer segments 104 in the non-circuit areas are isolated from the active patterns 44 and 90. The unetched thin film layer segments 104 within the non-circuit areas BA of the sublayer, of course, have the same thickness as the active patterns 90 in the circuit areas A2. As such, they advantageously will function along with the active patterns 90 to ,create a substantially uniform thickness in both circuit A1, A2 respectively, and non-circuit areas BA of the sublayer. As a result, when the top, polyimide insulation layer 30 is formed over the heater plate, the top surface 28 thereof will accordingly also be substantially flat, with no sagging in areas located over the non-circuit areas of the sublayer as happens in the case of conventional heater plates.

Referring now to FIG. 5C, a side-to-side cross-section (similar to that of FIG. 4B) is shown of a printhead of the present invention including the improved heater plate 26 of either FIG. 5A or FIG. 5B. As illustrated, when either heater plate 26 is adhesively bonded to a channel plate 12, good acceptable bonds 100 result over all walls W1, W2 . . . Wn that separate ink channels of the printhead. This is because the walls which according a circuit design would have had no active patterns therein, now have "dummy" or isolated patterns 102, 104 formed therein having a thickness equivalent to that of the active patterns. As a consequence, the polyimide layer 30 does not sag in locations above such walls, resulting advantageously in the good acceptable bonds 100, and in acceptable assembled printheads.

The invention has been described with reference to the preferred embodiments thereof, which are illustrative and not limiting. Various changes may be made without departing from the spirit and scope of the invention as defined in the appended claims.

I claim:

1. An improved heater plate for an ink jet printhead, the heater plate comprising:

(a) a silicon wafer base having a substantially flat first surface;

(b) a first insulating layer formed on said first surface of said wafer base;

(c) a second insulating layer spaced from said first insulating layer, said second insulating layer having a top surface for bonding the heater plate to a channel plate to form a printhead;

(d) a component sublayer formed between said second and said first insulating layers, said component sublayer including circuit and non-circuit areas, and having active patterns formed within said circuit areas defining said non-circuit areas; and (e) non-active relief-compensating patterns formed within said non-circuit areas of said component sublayer for making flat said top surface of said second insulating layer of the heater plate by preventing said second insulating layer from sagging in areas thereof located above said non-circuit areas of said component sublayer.

2. The improved heater plate of claim 1, wherein said second insulating layer is formed of polyimide material.

3. The improved heater plate of claim 1, wherein said component sublayer includes fully etched isolation gaps formed therein for isolating said non-active relief-compensating patterns from said active patterns.

4. The improved heater plate of claim 3, wherein said non-active relief-compensating patterns comprises unetched and retained segments of a thin film material forming said active patterns.

5. The improved heater plate of claim 1, wherein said component sublayer comprises a thin film metallization layer.

6. The improved heater plate of claim 5, wherein said thin film metallization layer is an aluminum layer.

7. The improved heater plate of claim 1, wherein said non-active relief-compensating patterns comprises "dummy" patterns of a non-active material formed within said non-circuit areas of said component sublayer.

8. The improved heater plate of claim 7, wherein said non-active "dummy" patterns each have a thickness substantially equal to a thickness of each of said active patterns.

9. The improved heater plate of claim 1, including a plurality of component sublayers located between said second and said first insulating layers.

10. The improved heater plate of claim 9, wherein said plurality of component sublayers includes a polysilicon layer.

11. The improved heater plate of claim 9, wherein said plurality of component sublayers includes a silicon dioxide layer.

12. The improved heater plate of claim 9, wherein said plurality of component sublayers includes a silicon nitride layer.

13. An ink jet printhead including a heater plate having a photopatterned top layer forming a top surface bonded to a channel plate, the improvement comprising:

a component sublayer of the heater plate including non-circuit areas, and non-active relief compensating patterns formed within said non-circuit areas for preventing the photopatterned top layer forming the top surface from sagging in areas located over said non-circuit areas of said component sublayer, thereby making flat the top surface.

14. The ink jet printhead of claim 13, wherein component sublayer comprises circuit areas and said non-active relief compensating patterns include unetched and retained thin film layer segments within said non-circuit areas that are isolated by fully etched gaps from active patterns in said circuit areas of said component sublayer thereby resulting in said component sublayer having substantially uniform thickness in said circuit areas and said non-circuit areas thereof.

15. The ink jet printhead of claim 13, wherein said non-active relief compensating patterns comprise nonactive "dummy" patterns of a non-active material photopatterned into said non-circuit areas of said component sublayer.

16. The ink jet printhead of claim 13, wherein said component sublayer is a metallization layer.

17. The ink jet printhead of claim 13, wherein said component sublayer is a polysilicon layer.

* * * * *